US011448029B2

(12) United States Patent
Fulton et al.

(10) Patent No.: US 11,448,029 B2
(45) Date of Patent: Sep. 20, 2022

(54) MULTI VESSEL METHOD AND SYSTEM FOR PLACING AN OBJECT ON A SEABED

(71) Applicant: InterMoor AS, Stavanger (NO)

(72) Inventors: Thomas Fulton, Cypress, TX (US); Bruno Amann Santana, Houston, TX (US); Allison Cribbs, Houston, TX (US); Jonathan Kent Longridge, Houston, TX (US); Regan Miller, Houston, TX (US)

(73) Assignee: InterMoor AS, Stavanger (NO)

( * ) Notice: Subject to any disclaimer, the term of this patent is extended or adjusted under 35 U.S.C. 154(b) by 0 days.

(21) Appl. No.: 17/286,980

(22) PCT Filed: Nov. 21, 2019

(86) PCT No.: PCT/NO2019/050256

§ 371 (c)(1),
(2) Date: Apr. 20, 2021

(87) PCT Pub. No.: WO2020/106162

PCT Pub. Date: May 28, 2020

(65) Prior Publication Data

US 2021/0388689 A1 Dec. 16, 2021

(30) Foreign Application Priority Data

Nov. 21, 2018 (NO) ..... 20181487

(51) Int. Cl.
*E21B 33/035* (2006.01)
*B63B 27/32* (2006.01)
*B63B 27/36* (2006.01)

(52) U.S. Cl.
CPC ..... *E21B 33/035* (2013.01); *B63B 27/32* (2013.01); *B63B 27/36* (2013.01)

(58) Field of Classification Search
CPC ... E21B 33/035; E21B 43/0122; B63B 27/32; B63B 27/36
See application file for complete search history.

(56) References Cited

U.S. PATENT DOCUMENTS 4,075,862 A * 2/1978 Ames ..... F16L 1/26 166/347
4,324,505 A 4/1982 Hammett
(Continued)

FOREIGN PATENT DOCUMENTS

EP 0260143 3/1988
GB 2205123 11/1988
(Continued)

OTHER PUBLICATIONS

Norwegian Search Report for No. 20181487, dated Jun. 21, 2019.
(Continued)

*Primary Examiner* — Matthew R Buck
(74) *Attorney, Agent, or Firm* — Andrus Intellectual Property Law, LLP

(57) ABSTRACT

A method is for placing an object on a seabed. The method includes connecting the object to at least two vessels by use of a work wire; attaching one or more buoyancy devices to the work wire, to achieve a distributed buoyancy of the work wire that forms a double curvature which disassociates at least some vessel movement from the object, to allow for controlled movement of the object; and co-operating the vessels to move the object into a position in a sea distant from the vessels, to lower the object to the seabed and to place the object on the seabed. Also described is a system for transporting an object to a position in a sea where the water comprises gas bubbles significantly lowering the load-car-
(Continued)

rying capacity of the water and for lowering the object to an area having a wellbore from which the gas bubbles enter the sea.

17 Claims, 6 Drawing Sheets

(56) References Cited

U.S. PATENT DOCUMENTS

| | | | | |
|---|---|---|---|---|
| 4,377,354 | A * | 3/1983 | Morton | F16L 1/165 405/158 |
| 5,215,410 | A * | 6/1993 | Karal | E02D 23/08 405/203 |
| 7,011,473 | B2 * | 3/2006 | Tangen | B63B 35/003 405/209 |
| 8,776,706 | B2 * | 7/2014 | Baylot | E21B 43/0122 114/331 |
| 2011/0274496 | A1 * | 11/2011 | Dvorak | E21B 43/0122 405/64 |
| 2012/0275274 | A1 | 11/2012 | Gochnour et al. | |
| 2013/0118754 | A1 | 5/2013 | Worrall et al. | |
| 2015/0308210 | A1 * | 10/2015 | Hanna | E21B 33/035 166/342 |
| 2016/0059943 | A1 * | 3/2016 | Chitwood | B63B 43/06 114/51 |

FOREIGN PATENT DOCUMENTS

| | | |
|---|---|---|
| WO | 2010144187 | 12/2010 |
| WO | 2016033278 | 3/2016 |

OTHER PUBLICATIONS

International Search Report and the Written Opinion for PCT Application No. PCT/NO2019/050256, dated Apr. 20, 2020.
Response to the Written Opinion for PCT Application No. PCT/NO2019/050256, dated Sep. 21, 2020.
Second Written Opinion for PCT Application No. PCT/NO2019/050256, dated Oct. 27, 2020.
International Preliminary Report on Patentability for PCT Application No. PCT/NO2019/050256, dated Mar. 1, 2021.

* cited by examiner

MULTI VESSEL METHOD AND SYSTEM FOR PLACING AN OBJECT ON A SEABED

CROSS-REFERENCE TO RELATED APPLICATIONS

This application is the U.S. national stage application of International Application PCT/NO2019/050256, filed Nov. 21, 2019, which international application was published on May 28, 2020, as International Publication WO 2020/106162 in the English language. The International Application claims priority of Norwegian Patent Application No. 20181487, filed Nov. 21, 2018. The international application and Norwegian application are both incorporated herein by reference, in entirety.

FIELD OF INVENTION

The present invention relates to the field of subsea-well technology, and in particular to subsea-well emergency response. The invention more particularly relates to containment of a well, to stop an uncontrolled release of hydrocarbons comprising a release of gas. However, the method and the system according to the invention may have further applications.

BACKGROUND

An uncontrolled release of hydrocarbons from a subsea well may be a catastrophic accident. Containing the well during such an accident is essential, and time is a crucial factor. During the tragic Macondo blowout, a number of attempts to contain the release of oil from the well were made. The attempts included using a containment dome, a top kill and junk shot, and a cap for funnelling oil and gas to a surface ship. All failed. Containment was not successful until a capping stack was installed 83 days after the blowout began.

For some wells, a capping stack may need to be deployed from a vessel. This can be done, in situations where the blowout does not comprise gas, by having a vessel position itself directly above the well and deploying and lowering the capping stack to the well from said position. If, however, the blowout does comprise gas, the water above the blowout, above the well, may typically be polluted by gas bubbles. Gas bubbles in water reduces the load-carrying capacity of the water and areas with gas bubbles are not safe for vessel operations due to the potential of noxious fumes, fire, and turbulence. Thus, a vessel cannot safely move or situate itself directly above the blowout as its buoyancy relative to the sea has been reduced.

The invention presents a way to solve the problem described above, thus making instalment of a capping stack from a vessel a viable option for containment of subsea blowouts comprising gas.

SUMMARY OF THE INVENTION

According to a first aspect of the invention, there is provided a method for placing an object on a seabed, the method comprising the steps of:

connecting the object to at least two vessels by use of a work wire;

attaching one or more buoyancy devices to the work wire, to achieve a distributed buoyancy of the work wire that forms a double curvature which disassociates at least some vessel movement from the object, to allow for controlled movement of the object; and co-operating the vessels to move the object into a position that is distant from the vessels, to lower the object to the seabed, and to place the object on the seabed.

According to a second aspect of the invention, there is provided a system for transporting an object to a position in a sea where the water comprises gas bubbles significantly lowering the load-carrying capacity of the water and for lowering the object to an area on a seabed having a wellbore from which the gas bubbles enter the sea, the system comprising:

at least two vessels;

a work wire for connecting the object to the vessels; and one or more buoyancy devices attached to the work wire, wherein the object is connected to the two vessels by use of the work wire, wherein the one or more buoyancy devices are arranged for the work wire to have a distributed buoyancy that forms a double curvature which dissociates at least some vessel movement from the object for allowing for controlled movement of the object, and wherein the system is arranged for holding and lowering the object in a position in the sea distant from the vessels and for placing the object on the seabed.

Note that "for placing an object on a seabed"/"to place the object on the seabed" is to be understood as to include placing the object directly on the seabed and/or placing the object on a target item or structure that is located in or on the seabed. The object may e.g. be a capping stack to be placed on a wellhead protruding from a seabed or a containment dome to be placed on a seabed to cover a wellhead. The object may otherwise be another object to be used for containment of a blowout or an object that it may be advantageous to lower to a position on a seabed where the water above said position has its load-carrying capacity reduced due to e.g. gas bubbles in the water or where it is advantageous for the vessels to not be above the final object location for other reasons.

Note further that the work wire may be any elongated fastening means for fastening two items together suitable for the purpose of connecting an object to at least two vessels and for carrying/supporting said object. It may be e.g. be a rope, a chain or a metal wire. It may be elastic or rigid. A wire may comprise of many parts and/or portions, wherein different portions or parts may consist of different materials and/or be different kinds of wires. The wire connecting the vessels to the object may be seen as one single wire, whether or not it comprises different parts or portions of equal or different types of wires, or it may be seen as a plurality of wires connecting the object to the vessels. E.g. a wire may comprise a section of buoys connected by a chain or a plurality of chains and a section of steel wire, it may comprise nothing but a single piece of steel wire, it may comprise nothing but a chain, it may comprise a multitude of different sections including e.g. one or more chains, one or more steel wires, one or more ropes, one or more buoyancy elements, one or more connector, and more. An advantage of having the wire comprise of different parts may be the it may be to make parts of a wire more rigid whereas another part may advantageously be more flexible, to make one part of a wire more resistant to a type of wear and another part more resistant to another type of wear, etc. An advantage of having a wire comprise nothing but e.g. a length of steel wire may be that the wire is made less complex and/or possible less likely to have one or more weak points.

Note further that the buoyancy elements may be any components with the purpose of providing positive buoyancy. The buoyancy elements may be made from a synthetic material or steel, any combination thereof, or any other material suitable for the purpose. A buoyancy element may comprise many parts and/or portions, wherein different portions or parts may consist of different materials. The buoyancy elements may be different kind of buoys.

"Co-operating the vessels" may include e.g. moving the vessels relative to each other, moving the vessels relative to a position in the sea, and/or using equipment to move the object in the sea and/or to lower the object. The equipment may e.g. be a winch.

The object may be connected to the two or more vessels prior to deployment of the object into the sea, or while the object is kept at or near surface level.

The at least two vessels may typically be two surface vessels. The vessels may typically co-operate to position themselves on a surface of a sea and, through the positioning of the vessels, to position the object in an area in or on the sea wherein the sea has reduced carrying capacity. The area of the sea wherein the object is being positioned may e.g. be an area substantially directly above a blowout-site, and the object may be an object to contain the blowout. Subsequently of positioning themselves and the object, the at least two vessels may co-operate to lower the object towards the seabed.

By co-operating two or more vessels to move the object into a position and to lower the object, a vessel does not have to position itself directly above or near directly above a blowout well. The vessels can be positioned distant from the blowout. This enables e.g. deploying a capping stack from a vessel to contaminate a blowout when the uncontrolled release of hydrocarbons comprises hydrocarbon gas.

More than two vessels may be used for the method. The object may be connected to e.g. three or four vessels, or more than four vessels, and moved in place by co-operating the vessels.

"A position that is distant from the vessels" in the context of the claims and the description may be quantitatively defined e.g. as a position at a distance of between 50 meters and 1000 meters from the vessels. The distance may shorter than 50 metres, such as 25 metres, 10 metres or longer than 1000 metres, such as 1200 metres, 2000 metres, 5000 metres, etc. It may e.g. be a distance of between 25 metres and 500 metres, a distance of between 75 metres and 2000 metres, or a distance of between 30 metres and 900 metres.

"A position that is distant from the vessels" may be qualitatively defined, in the context of the claims and the description, as a position a safe distance away from an area of a body of water that is affected by gas bubbles lowering the load-carrying capacity of the water. The gas bubbles may enter the body of water e.g. from a seabed and/or a wellbore. "A position a safe distance away" may be a position wherein the load-carrying capacity of the water is not affected by the gas bubbles or where the effect of the bubbles is so small that one or more vessels being a part of the system according to the invention or for carrying out the method according to the invention can safely move and/or stay without an unacceptable risk of sinking.

The method may comprise the step of adjusting a length of work wire released from a vessel to adjust the position of the object in the sea and/or to lower the object to the seabed. The length of the work wire released may be increased to lower the object in the sea or decreased to raise the object in the sea. The step of adjusting the length may be performed by use of a winch. The system may comprise a means for adjusting the length of released work wire, such as a winch.

Adjusting the length of the work wire may be advantageous to allow for a more accurate and less complicated positioning and lowering of the object than if the length of work wire from one or more vessels was fixed and the only way to move and/or lower the object was to move one or more vessels.

The method may comprise the step of shutting down a well to end an uncontrolled release of gas and/or oil from the well and/or containing an uncontrolled release of hydrocarbons/a blowout from a wellbore by placing the object on the seabed to cover the top of the well and/or by placing the object over a top end of the wellbore and/or by connecting the object to a wellbore. The object may be a capping stack and the capping stack may be placed onto a wellhead or otherwise connected to the wellbore to contain an uncontrolled release of hydrocarbons. The object may e.g. be a containment dome, and it may be placed over a top end of the wellbore to contain a blowout. The object may be another object than a containment dome or a capping stack and/or it may be used for other purposes than for containment purposes.

Furthermore, the method may comprise the step of connecting the object to one or more buoyancy devices and/or other heave-compensating devices. "Connecting the object to one or more buoyancy devices" includes both connecting the object directly to one or more buoyancy devices and connecting the object indirectly to one or more buoyancy devices, e.g. by having buoyancy devices connected to the work wire, e.g. by being arranged around a portion of the work wire. The system may comprise one or more buoyancy devices. Having buoyancy devices connected to the object may be advantageous for improving control and pacing of vertical movement of the object. A plurality of buoyancy devices may be connected to the object. Arranging a plurality of buoyancy devices in connection with the object may be particularly advantageous. Spreading the plurality of buoyancy devices in a symmetrical fashion along the work wire or wires leading from the object to the vessels may be even more advantageous.

Buoyancy devices may be arranged on the work wire in a distributed manner to form a double curvature of the lowering line, to disassociate the vessel's motion from e.g. waves of the seas from the object being lowered. This allows the object being lowered to be gently or safely installed on the seabed or place on another object near the seabed with minimal velocity or acceleration.

Further, in an advantageous embodiment, the one or more buoyancy devices may be arranged such that they in an operational position is placed such that they are not influenced by wave motions—e.g. below a surface of the sea. If the buoyancy devices are not out of the wave motion, the wave motion may induce movement of the buoyancy devices which could induce unwanted movement of the object being lowered.

One or more buoyancy devices connected to the object may be buoyancy devices having adjustable buoyancy. This may advantageously further increase control and pacing of lowering of the object. The buoyancy device may have adjustable buoyancy e.g. by being arranged for taking in water when the surrounding water pressure increases over a certain threshold or by having a valve that can be opened to take in water. The buoyancy device may be arranged to have its buoyancy increased or to have it decreased. The system may comprise one or more buoyancy devices having adjustable buoyancy.

The method may further comprise the step of connecting a relief wire to the object from at least one of the vessels to carry at least a portion of a gravitational load from the object. The relief wire may be used e.g. to carry a load from the object for deployment of a buoyancy device from a vessel, to avoid having excessive gravitational forces damage the buoyancy devices. The object may be connected by one or more relief wires to more than one vessel. The length of the relief wire released from a vessel may be adjustable, e.g. by use of a winch. The system may comprise one or more relief wires.

An ROV may be used to monitor the position of the object in the water to improve accuracy of the step of co-operating the vessels to lower the object to the seabed. The method may comprise the step to use the ROV to monitor the position of the object. It may further comprise the step to deploy the ROV. Furthermore, the method may comprise the step of using the ROV to monitor the seabed and/or equipment on the seabed. Furthermore, the method may comprise the step of communicating information gathered by the ROV to one or more vessels by use of means for communication of such information. The system may comprise an ROV.

Alternatively, or in addition, a transponder may be used to increase accuracy when lowering/positioning the object. The method may comprise the step of using a transponder placed at or near the object to monitor the position of the object to improve accuracy of the step of co-operating the vessels to lower the object to the seabed. Information gathered from the transponder may be communicated to one or more vessels by use of means for communication of such information. The system may comprise a transponder.

The system may comprise communication means for communicating between the vessels to co-operate in transporting the object and/or in lowering the object to the seabed. Communication means may be highly advantageous to ensure safe and accurate transport and placing of the object. The communication means may comprise means for radio communication, video communication, communication of digital data, and more. In the following is described an example of a preferred embodiment of the system and an example of the method illustrated in the accompanying drawings, wherein.

Note that the drawings are schematic and not necessarily drawn to scale.

Figure 1:
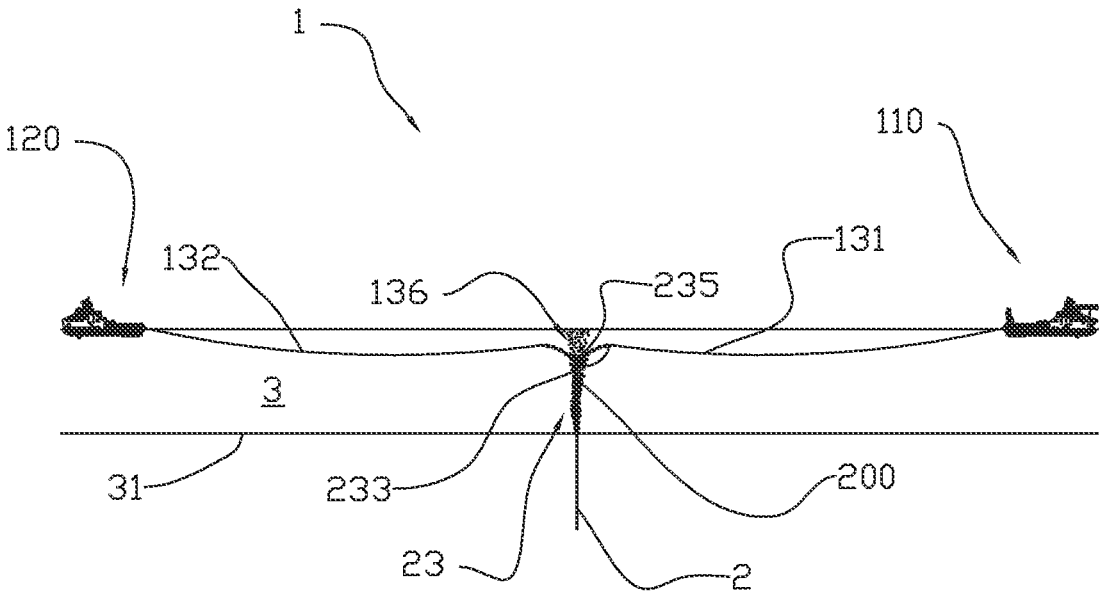
FIG. 1 shows an embodiment of the invention, where two vessels are connected to a capping stack and have moved it to a position in a sea over a wellbore.

FIG. 1 shows a system 1 for transporting an object 200 to a position in a sea 3 where the water in the sea 3 comprises gas bubbles 23 significantly lowering the load-carrying capacity of the water and for lowering the object 200 to an area on a seabed 31 having a wellbore 2 from which wellbore the gas bubbles 23 enter the sea 3.

The system 1 comprises two vessels 110, 120, two work wires 131, 132, an object-supporting wire 233, a connector 235 for connecting the work wires to each other and to the object-supporting wire 233, and the object 200.

The object 200, in the embodiment shown in the figures, is a capping stack 200 for establishing control of the wellbore 2 which is having a blowout comprising gas, causing the gas bubbles 23 to enter the sea.

The system 1 enables deploying a capping stack 200 or other well-containment equipment from a vessel 110, 120 during a blowout comprising gas, as it allows the vessels 110, 120 involved to keep a safe distance to the blowout site and thus to avoid an area of water having its load-carrying ability reduced.

By using two vessels 110, 120 and two work wires 131, 132 connected to the capping stack 200, the capping stack 200 can safely be moved to the correct position in the sea 3 and lowered to the seabed 31 and/or the wellbore 2. The work wires 131, 132 extending from the vessels 110, 120 to the connector 135 can be 100 metres long but can of course be either longer or shorter. One or more of the vessels 110, 120 can have a winch (not shown) or other means (not shown) for changing the length of released work wire 131, 132 from the vessel or vessels 110, 120. The position of the capping stack 200 in the sea 3 can be changed by moving one or more of the vessels 110, 120 and/or by using the means for changing the length of released work wire or wires 131, 132.

Buoyancy devices 136 are fastened to the work wires 131, 132, to form a double curvature in the lowering line to disassociate the vessel 110, 120 motions from increase the buoyancy near the capping stack 200. The reduction in increased buoyancy provided by the buoyancy can e.g. improve the motions and accuracy when lowering the capping stack 200 to the seabed 31.

The system 1 may also be used to raise equipment from the seabed 31 in a sea where gas bubbles decreases the load-carrying capacity of the water.

Figure 2:
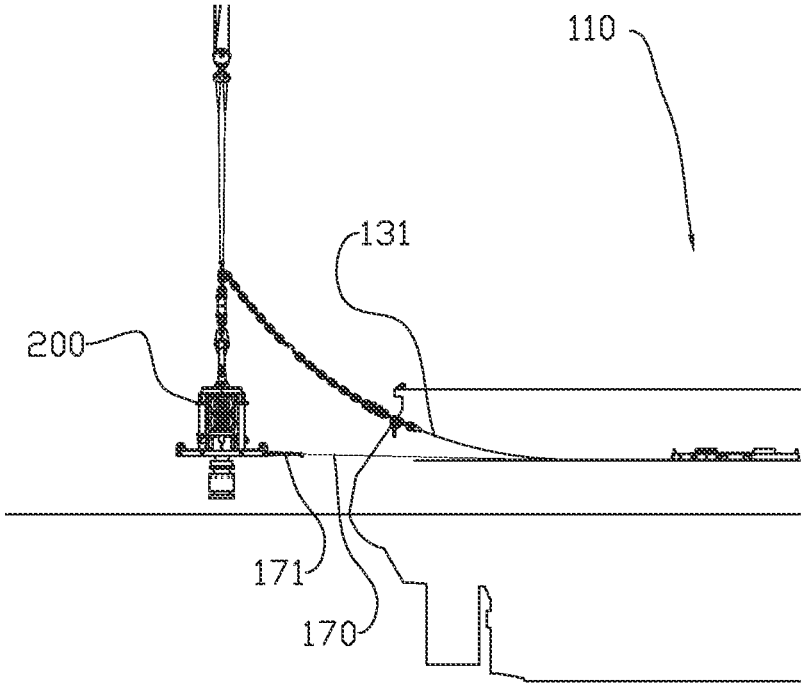
FIG. 2 shows a capping stack being deployed from a vessel.

FIG. 2 shows how a capping stack 200 to be used as part of the system 1 can be deployed. This can typically be done by use of a crane (not shown) from a dock or a barge (not shown) or a crane or an A-frame (not shown) aboard the vessel 110. The capping stack 200 is hoisted to a vessel 110 and connected to the vessel 110 by use of a work wire 131 and a tugging wire 170 and suspended by use of said wires 131, 170 from the stern of the vessel 110. The end portion of the tugging wire 170 has a tugger 171 for tugging the capping stack 200 to avoid or decrease movement of the capping stack 200 while its suspended from the stern of the vessel 110.

As a next step of the method, the vessel 110 and a second vessel 120 can typically travel to an area near a blowout-site. When reaching the area, the capping stack 200 may be connected to both vessels 110, 120 and subsequently deployed into the sea 3.

Figure 3:
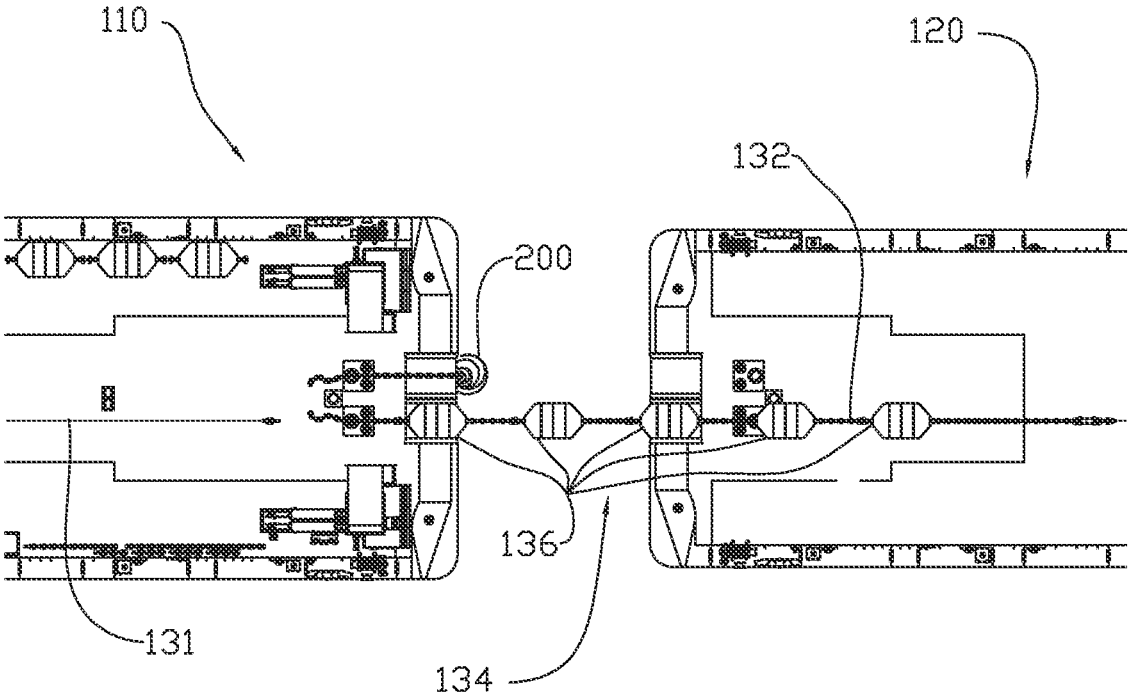
FIG. 3 shows two vessels as the work wire is being fed from a first vessel to a second vessel.

In FIG. 3 it is shown how a work wire 131 of one vessel 110 can be connected to a work wire 132 of another vessel 120. The two vessels 110, 120 align stern-to-stern, and the work wire 131 of the second vessel 120 is passed to the first vessel 110. In the embodiment shown in FIG. 3, the work wire 132 of the second vessel 120 has a buoy sling 134 comprising a plurality of buoyancy devices 136 in the form of buoys 136. When the work wire 132 of the second vessel has been passed to the first vessel 110 it can be connected to the work wire 131 of the first vessel 110.

Furthermore, FIG. 3 shows the capping stack 200 suspended from the stern of the first vessel 110.

Figure 4:
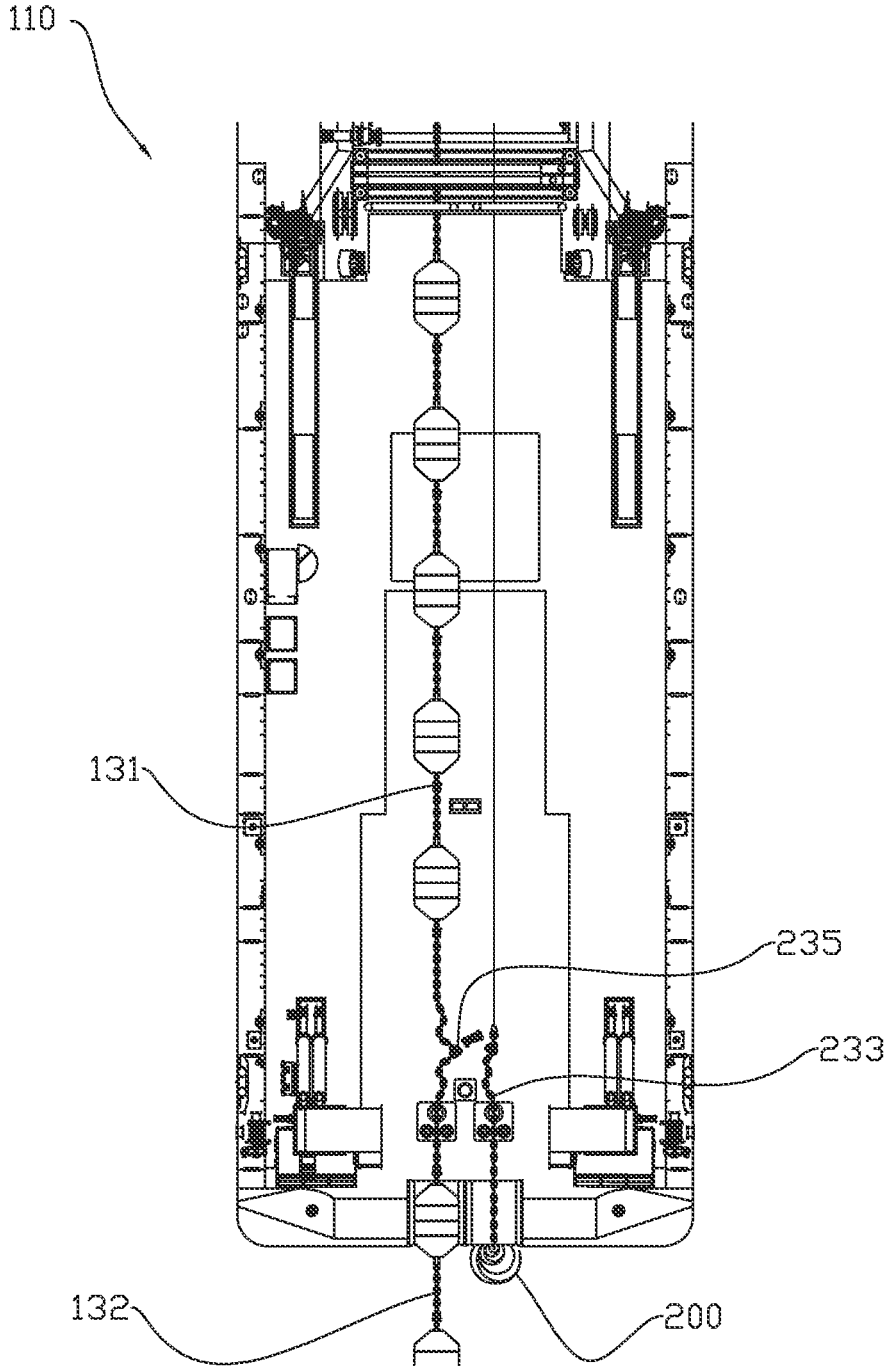
FIG. 4 shows the first vessel as a wire for connecting the object to the second vessel and a wire for connecting the object to the first vessel are being connected to each other and to the object via a triplate.

FIG. 4 shows the first vessel 110 having the work wire 132 of the second vessel 120 (not shown) on its deck and connected by use of a connector 235 in the form of a triplate 235 to the work wire 131 of the first vessel 110. The connector 235 can of course be another type of connector 235 suitable for the purpose. Furthermore, the capping stack 200 is shown suspended from the stern of the first vessel 110 and connected to an object-supporting wire 233. The object-supporting wire 233 is about to be connected by use of the connector 235 to the work wires 131, 132.

Figure 5:
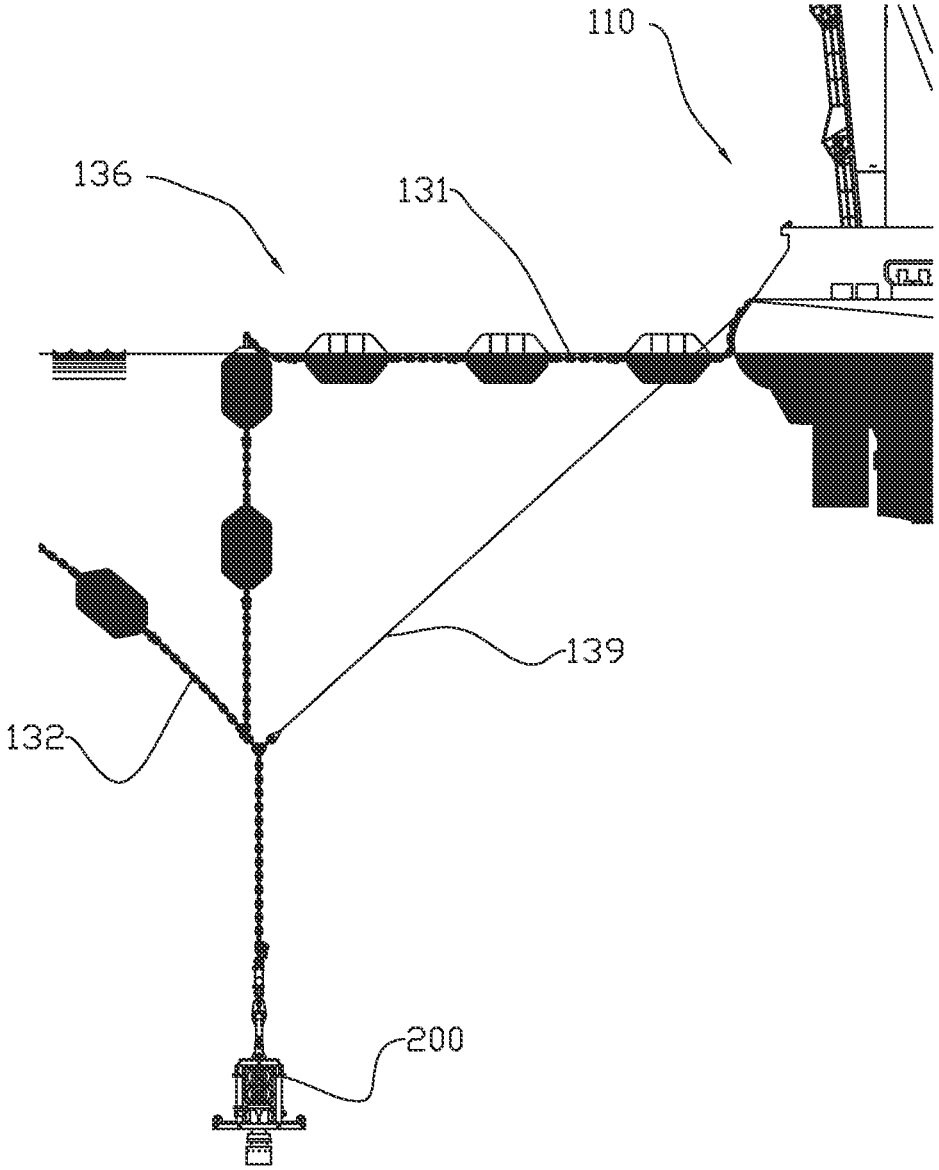
FIG. 5 shows a relief wire being used to carry a load from the object as buoys are being deployed from the vessel.

FIG. 5 shows the capping stack 200 being suspended from the first vessel 110 by use of a relief wire 139 and from the second vessel (not shown) by use of the work wire 132 of the second vessel 120 as buoyancy devices 136 in the form of buoys are being deployed from the first vessel 110. This is done to reduce the gravitational load from the capping stack 200 affecting the buoys 136 as they are moved off the stern of the first vessel 110, to avoid damaging the buoys 136.

Figure 6:
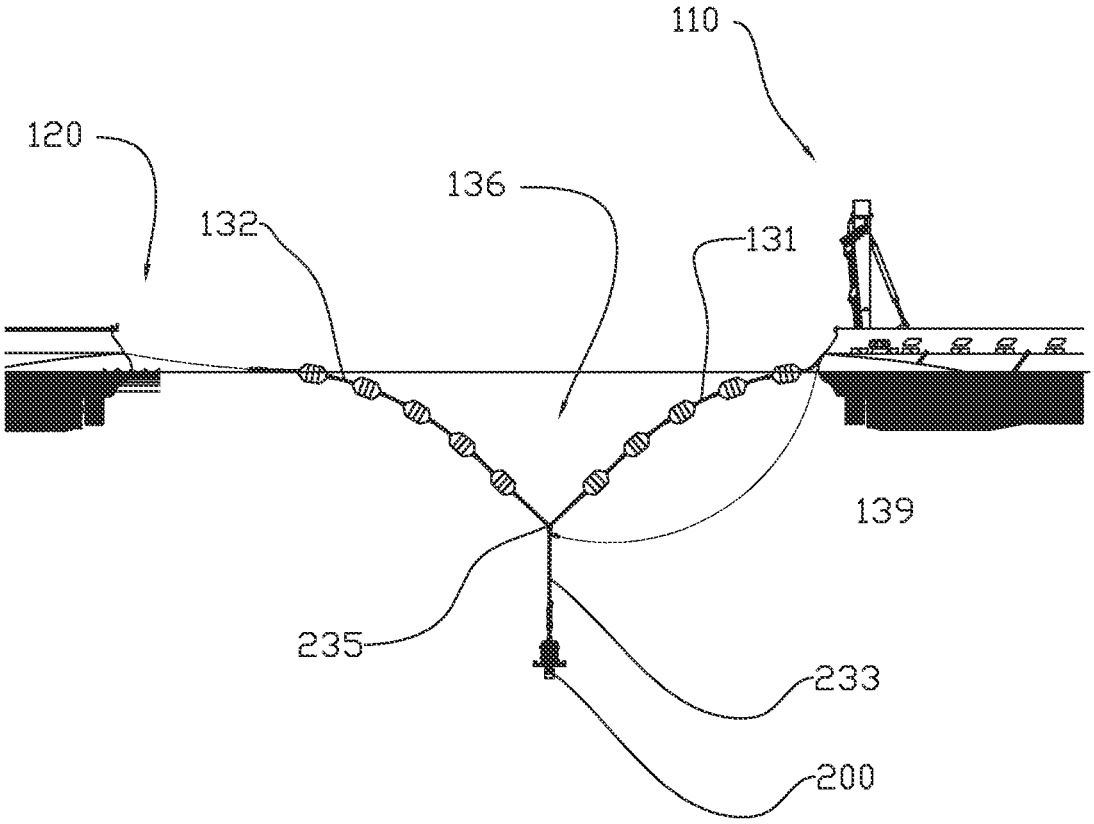
FIG. 6 shows the object being suspended from two vessels following deployment of buoyancy devices.

In FIG. 6, the capping stack 200 is shown suspended from the work wires 131, 132 from the two vessels 110, 120 via the object-supporting wire 233, following deployment of all buoyancy devices 136. The relief wire 139 no longer carries load from the capping stack 200.

When the capping stack 200 and the buoyancy devices 136 have been deployed, the vessels 110, 120 travel into a position in the sea where the water safely carries their weight while simultaneously moving the capping stack 200 into a position where gas bubbles 23 reduce the load-carrying capacity of the water, as seen in FIG. 1. While travelling into position, the necessary length of work wire 131, 132 is released from the vessels 110, 120.

When the two vessels 110, 120 and the capping stack 200 are in position, the object can be lowered to the seabed 31 and mounted onto a wellhead or otherwise connected to the well.

During lowering of the capping stack 200 to the seabed 31, an ROV and/or a transponder can be used, or any other means for providing information on the location of the capping stack 200 in the sea 3 and/or the position of the capping stack 200 relative to the seabed 31 and/or well. The capping stack 200 can be lowered to the seabed through movement of one or more of the vessels 110, 120 and/or by use of a means of paying out or pulling in work wire 131, 132.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A method for placing an object on a seabed, the method comprising the steps of:

connecting the object to at least two vessels by use of a work wire;

attaching one or more buoyancy devices to the work wire such that the one or more buoyancy devices provide buoyancy to the work wire and to the object via the work wire, to achieve a distributed buoyancy of the work wire that forms a double curvature which dissociates at least some vessel movement from the object, to allow for controlled movement of the object; and co-operating the vessels to move the object into a position in a sea distant from the vessels, to lower the object to the seabed and to place the object on the seabed.

2. The method according to claim 1, wherein the method comprises the step of:

adjusting a length of the work wire released from at least one of the vessels to adjust the position of the object in the sea and to lower the object to the seabed.

3. The method according to claim 1, wherein the object is a capping stack and wherein the method further comprises the step of:

containing an uncontrolled release of hydrocarbons from a wellbore by connecting the capping stack to the wellbore.

4. The method according to claim 1, wherein at least one of the one or more buoyancy devices has adjustable buoyancy, wherein the method further comprises the step of:

adjusting the buoyancy of the at least one of the one or more buoyancy devices.

5. The method according to claim 1, wherein the method comprises the step of:

shutting down a wellbore to end an uncontrolled release of gas and oil from the well by placing the object on the seabed to cover the top of the well-bore.

6. The method according to claim 1, wherein the method comprises the step of:

connecting a relief wire to the object from at least one of the vessels to carry at least a portion of a gravitational load from the object.

7. The method according to claim 6, wherein the relief wire is used to carry a gravitational load from the object while deploying at least one of the one or more buoyancy devices from at least one of the at least two vessels.

8. The method according to claim 1, wherein the method further comprises the steps of:

deploying an ROV; and using the ROV to monitor the position of the object to improve accuracy of the step of co-operating the vessels to lower the object to the sea-bed.

9. The method according to claim 1, wherein the method further comprises the step of:

using a transponder placed at or near the object to monitor the position of the object to improve accuracy of the step of co-operating the vessels to lower the object to the seabed.

10. The system according to claim 1, wherein the double curvature is formed by the work wire curving downwardly between each of the at least two vessels and the object, respectively.

11. A system for transporting an object to a position in a sea where the water comprises gas bubbles significantly lowering the load-carrying capacity of the water and for lowering the object to an area on a seabed having a well-bore from which the gas bubbles enter the sea, the system comprising:

at least two vessels;

a work wire for connecting the object to the vessels; and one or more buoyancy devices attached to the work wire, wherein the object is connected to the two vessels by use of the work wire such that the one or more buoyancy devices provide buoyancy to the work wire and to the object via the work wire, wherein the one or more buoyancy devices are arranged for the work wire to have a distributed buoyancy that forms a double curvature which dissociates at least some vessel movement from the object for allowing for controlled movement of the object, and wherein the system is arranged for holding and lowering the object in a position in the sea distant from the vessels and for placing the object on the seabed.

12. The system according to claim 11, wherein the vessels comprises communication means for communicating between the vessels to co-operate in transporting the object and in lowering the object to the seabed.

13. The system according to claim 11, wherein the system further comprises a transponder located on or close to the object and an ROV for providing data on the position of the object in the sea.

14. The system according to claim 11, where at least one buoyancy device has adjustable buoyancy.

15. The system according to claim 11, wherein the system comprises a relief wire for carrying at least a portion of a gravitational load from the object, wherein said relief wire is connected to the object and to at least one of the vessels.

16. The system according to claim 11, wherein the system mitigates heave, or motions in general, from the vessels.

17. The system according to claim 11, wherein the double curvature is formed by the work wire curving downwardly between each of the at least two vessels and the object, respectively.

* * * * *